United States Patent [19]

Zimmern et al.

[11] Patent Number: 4,903,497

[45] Date of Patent: Feb. 27, 1990

[54] METHODS AND DEVICES FOR COOLING A MOTOR OF A REFRIGERATING MACHINE WITH LIQUID AND ECONOMIZER GAS

[75] Inventors: Bernard Zimmern, 6 New St., East Norwalk, Conn. 06855; Joseph L. Knopp, Staunton, Va.

[73] Assignee: Bernard Zimmern, East Norwalk, Conn.

[21] Appl. No.: 238,279

[22] Filed: Aug. 30, 1988

[30] Foreign Application Priority Data

Sep. 4, 1987 [FR] France ..... 87 12338

[51] Int. Cl.[4] ..... F25B 31/02

[52] U.S. Cl. ..... 62/113; 62/197; 62/505; 62/513

[58] Field of Search ..... 62/505, 513, 113, 117, 62/197; 417/366, 368, 369, 370, 371; 310/54, 61, 62, 63, 64, 65

[56] References Cited

U.S. PATENT DOCUMENTS

| | | | |
|---|---|---|---|
| 3,122,894 | 3/1964 | Bernhard | 62/505 X |
| 3,241,331 | 3/1966 | Endress et al. | 62/505 X |
| 3,388,559 | 6/1968 | Johnson | 62/505 X |
| 3,913,346 | 10/1975 | Moody, Jr. et al. | 62/197 |
| 4,182,137 | 1/1980 | Erth | 310/61 X |
| 4,573,324 | 3/1986 | Tischer et al. | 62/115 |

FOREIGN PATENT DOCUMENTS

| | | |
|---|---|---|
| 1331998 | 6/1963 | France . |
| 2541437 | 8/1984 | France . |
| 2559555 | 8/1985 | France . |
| 863955 | 3/1961 | United Kingdom . |

*Primary Examiner*—Harry B. Tanner

*Attorney, Agent, or Firm*—Young & Thompson

[57] ABSTRACT

Liquid coming from the condenser or present in the fluid discharged by the compressor circulates in grooves provided between a stator 7 and a housing 10 of the motor at a distance from the coils (8, 9) thereof. The liquid cools the stator without any risk of short-circuit in the coils. The liquid may be urged by a centrifugal economizer separator 13 through the liquid outlet 16 thereof, towards liquid inlets 27 and 27'. The pressurized gas produced by separator 13 is sent in the motor housing through slit 17 and then, having cooled the coils, reaches economizer hole 12 of the compressor, through conduit 11. Thus, the heated gas is not sent to the intake of the compressor where it would reduce the compressor capacity and efficiency.

23 Claims, 3 Drawing Sheets

METHODS AND DEVICES FOR COOLING A MOTOR OF A REFRIGERATING MACHINE WITH LIQUID AND ECONOMIZER GAS

TECHNICAL FIELD

This invention relates to a method of cooling an electric motor of a refrigerating machine with refrigerant gas and liquid.

This invention also relates to a hermetic motor compressor unit and to a refrigerating machine in which the motor is cooled by refrigerant gas and liquid.

TECHNICAL BACKGROUND

In known hermetic motor compressor units for refrigeration, the compressor is driven by an electrical motor cooled by the refrigerant gas to be compressed.

Such a method of cooling reduces efficiency of the compressor, since the specific weight of the gas taken in by the compressor is reduced by heating whereas the work to be done by the compressor remains the same. It is therefore known, particularly in the case of rotary compressors, to cool the motor by liquid refrigerant coming from the condenser, the gas flashing out being sent to an economiser hole provided in the compressor casing at a pressure intermediate between intake pressure and discharge pressure of the compressor when compressor operates at full load.

Such a method and apparatus is disclosed in U.S. Pat. No. 4,573,324.

Such a method does not raise any particular problems with refrigerant such as those known under the names "R11" or "R12". However, in the case of the refrigerant known as "R22", because of the relatively high conductivity of liquid R22, the method requires special insulation of the electric wires of the motor, such as wrapping the wire with glass material embedded in epoxy, whereas a simple varnish coating is needed in hermetic compressors in which the motor is cooled with R22 in gaseous form only; this increases the weight and cost of such a motor considerably.

U.S. Pat. No. 4,589,826 to Bernard ZIMMERN discloses a method of cooling the motor partly by liquid, partly by gas with the gas being at intake pressure whereas liquid can be at a higher pressure; this method, whereas maintaining the coils out of contact with liquid R22 is not very efficient as part of the heat of the motor continues to be taken away by gas reaching then the intake of the compressor. Furthermore, such method raises the problem that if the gas leaving the evaporator towards the motor housing contains liquid, it gives the same troubles as explained before; therefore, this known method needs that the gas be superheated in the evaporator. This entails the need of larger evaporators, as will be explained later.

OBJECT OF THE INVENTION

The object of the invention is to provide cooling of the motor with refrigerant fluid while entailing neither the need of a larger evaporator, and of a special insulation of the motor coils, nor a drop in the compressor efficiency.

SUMMARY OF THE INVENTION

According to a first aspect of the invention, there is provided a method of cooling an electric motor of an hermetic motor compressor unit for compressing a main flow of refrigerant fluid in an at least partly gaseous state for supplying a refrigerating circuit, in which such fluid is liquefied at least in part in a condenser and is vaporized at least in part in an evaporator, said method comprising the steps of:

in said refrigerating circuit, separating a substantially gaseous pressurized first flow of refrigerant fluid from said main flow supplying said first flow in a motor cavity provided inside a motor housing adjacent to a first side of a stator of said motor, said first side facing a rotor of said motor supplying said first flow from said motor cavity into the compressor through an economiser hole thereof subjected, in operation, at least at full load, to a pressure intermediate between an intake pressure and a discharge pressure of said compressor; and supplying with a second, at least partly liquid, flow of refrigerant fluid a path in which said second flow is in heat exchange relationship with a second side of said stator, remote from said first side.

According to a second aspect of the invention, there is provided a hermetic motor compressor unit comprising a rotary compressor adapted to compress a main flow of refrigerant fluid, an electric motor drivingly coupled to said rotary compressor for rotation therewith, said electric motor comprising a rotor mounted onto a shaft connecting the motor to the compressor, a stator mounted adjacent to the rotor in a motor housing connected to a casing of the compressor, separation means for separating in said refrigerant fluid a substantially gaseous portion thereof, means for supplying with said substantially gaseous portion a motor cavity provided in said housing adjacent a first side of said stator, said first side facing said rotor, conduit means connecting said motor cavity with a hole provided in the compressor casing in such a position as to be subjected, in use at full load, to a pressure intermediate between an intake pressure and a discharge pressure of the compressor, and channel means for guiding refrigerant fluid in heat exchange relationship with a second side of said stator, said second side being remote from said first side.

According to a third aspect of the invention, there is provided a refrigerating machine comprising a hermetic compressor unit comprising a rotary compressor, a refrigerating circuit mounted operatively between a discharge port and an intake port of said compressor, an electric motor drivingly coupled to said rotary compressor for rotation therewith, said electric motor comprising a motor-rotor drivingly coupled to a compressor-rotor, a stator mounted adjacent to the motor-rotor in a motor housing connected to a casing of the compressor, separation means for separating in said refrigerating circuit a substantially gaseous portion of a refrigerant fluid present in use in said circuit, means for supplying with said substantially gaseous portion a motor cavity provided in said housing adjacent a first side of said stator, said first side facing said motor-rotor, conduit means connecting said motor cavity with a hole provided in the compressor casing in such a position as to be subjected, in use at full load, to a pressure intermediate between an intake pressure and a discharge pressure of the compressor, and channel means for guiding refrigerant fluid in heat exchange relationship with said stator adjacent a second side thereof remote from said first side.

The invention makes it possible to achieve some results impossible to achieve with liquid cooling only or economiser gas only.

Firstly, as in U.S. Pat. No. 4,589,826, gas can be used to cool the rotor and the end turns of the coils protruding from the stator whereas liquid is use only to cool the stator. This eliminates the risk of liquid R-22 contacting those coils while at the same time nevertheless allowing liquid to contact the stator where most of the heat is dissipated.

Secondly, one could imagine to cool the stack by liquid and use the flash gas of said liquid to cool the end turns. However, the use of a combination of liquid and of pressurised gas sent thereafter to the economiser hole of the compressor gives a much more stable solution; would there be only liquid, most of the heat would be dissipated by vaporization as specific heat of the gas is quite small compared to latent heat of vaporization; so any little lack of liquid would entail significant overheating of the gas having vaporized; the exact amount of liquid would be very difficult to control and for this reason it would be necessary to supply the motor with an excess of liquid, leading to the electrical insulation problem mentioned above. When, as proposed by the invention, economiser gas is used in conjunction with liquid, the weight of economiser gas available for cooling is considerably more than the weight of liquid in prior case and most of the cooling is achieved by heating gas, only a little balance has to be provided by liquid. This results in an easy control and ensures that gas having cooled the motor coils before going to the economiser hole is superheated only within tolerable limits.

This is particularly true if gas entering the motor is itself not superheated. This can be achieved by using a centrifugal economiser as described in U.S. Pat. No. 4,509,341.

It should be also noted that gas exiting from the evaporator may be deprived from superheat and even wet with liquid, without creating to the electric coils the problems that would arise if the motor was partially or totally cooled by intake gas and this, as will be explained, creates substantial savings on the evaporator size.

Despite what has been said herein above concerning insulation problems with some kinds of liquid refrigerants, such as R22, there may be without problems a small liquid amount in the motor cavity, especially a mist thereof. It seems that the problems only arise with drops having a substantial size. Therefore, it suffices that the gas flow in the motor cavity be only substantially gaseous.

BRIEF DESCRIPTION OF THE DRAWINGS

This invention will be better understood when reading the following description together with the appended drawings given as non-limiting examples in which.

DESCRIPTION OF EMBODIMENTS

Figure 1:
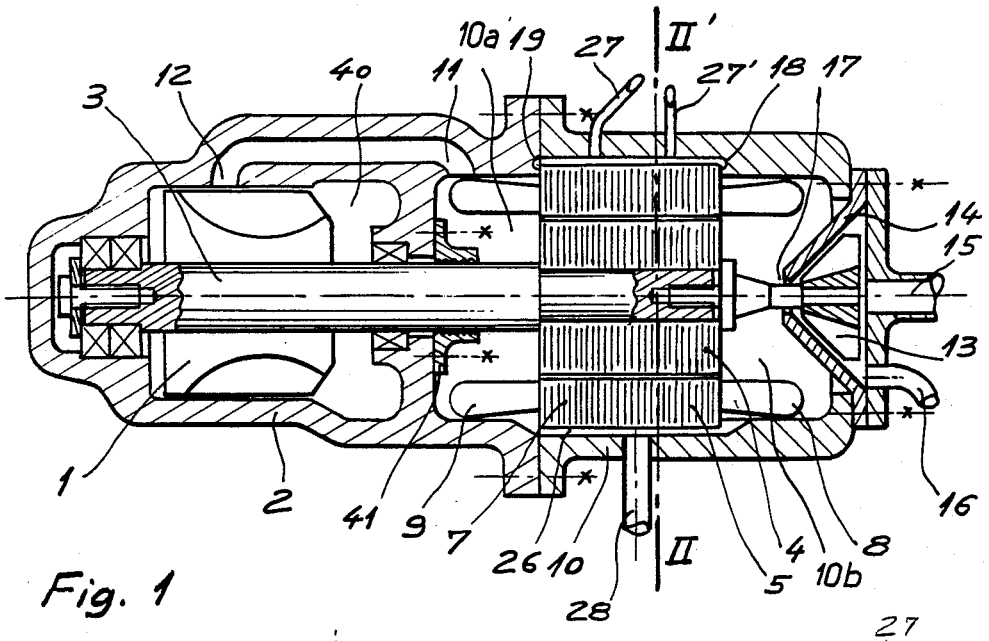
FIG. 1 is a cross sectional view of a hermetic motor-compressor unit according to the invention.

As shown in FIG. 1, a rotary compressor may be made for instance of a screw 1 sealingly meshing in a well-known manner, described in patents such as U.S. Pat. No. 3,180,565, with gate rotors or pinions not represented. Screw 1 rotates inside a casing 2 and forms with said gate rotors and casing, between the screw thread crests of the screw, compression chambers the volume of which varies, as the screw rotates, from a maximum when communicating with an intake region 40 to a minimum when registering with a discharge port. The intake region 40 is connected to an intake port. The intake and discharge ports are well-known and have not been represented either. The compressor is part of a refrigerating circuit comprising in series in the following order between the discharge port and the intake port of the compressor: a condenser, an expansion valve and an evaporator.

The screw 1 is mounted on and rotably driven by a shaft 3 on which is secured a rotor 4 of an electric motor. Said motor moreover comprises, around the rotor 4, a stator 5 made of a stack 7 of steel laminates, and copper coils protruding in 8 and 9 at each end of the stack. The stack is tight-fitted in a housing 10 attached to the casing 2 of the compressor.

The motor cavity, i.e. the cavity inside the housing 10, is separated from the intake space 40 of the compressor by a labyrinth seal 41.

The motor cavity is connected by a conduit 11 to an aperture—or economiser hole—12 provided through the inner face of the casing 2 of the compressor. When the compressor operates at full load, the pressure in front of said economiser hole is intermediate between the intake and the discharge pressure. This is due to the economiser hole 12 being positioned to register with each compression chamber when having a volume intermediate between maximum and minimum. At an end of shaft 3 which is remote from the compressor, there is a bladed rotor 13 secured to shaft 3 and rotating inside an envelope 14 to form an economiser device in accordance with U.S. Pat. No. 4,509,341. The envelope 14 is connected to an inlet tube 15 through which a mixture of gas and liquid, coming from the condenser, enters envelope 14 adjacent to the axis of rotor 13. The liquid is urged radially outwardly due to centrifugation and leaves towards the evaporator by tube 16 adjacent to the periphery of envelope 14, and the gas separated from the liquid by the rotor 13 is entering the motor cavity by an annular space 17 between the envelope 14 and a central shaft of rotor 13.

The stack is axially tightly maintained between two inner shoulder faces 18 and 19 of the motor cavity, belonging respectively to the motor housing and to the compressor casing. The motor cavity has two parts 10a and 10b on either side of the stack 7.

Figure 2:
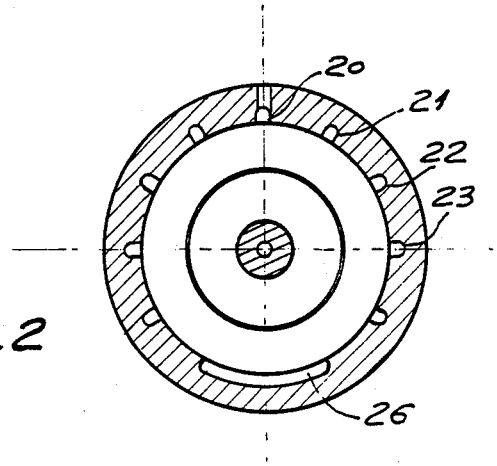
FIG. 2 is a simplified cross-section along II—II' of FIG. 1
Figure 3:
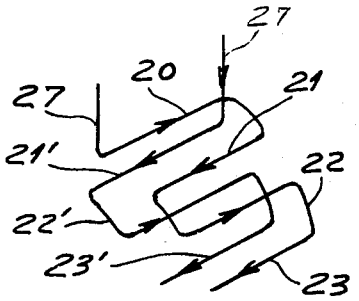
FIG. 3 is a three dimensional view of channels of FIG. 2.
Figure 4:
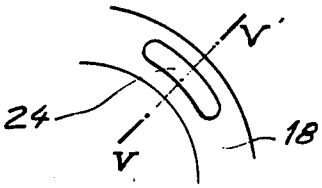
FIG. 4 is a fragmentary perspective view of a portion of the motor housing of FIG. 1
Figure 5:
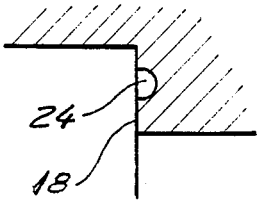
FIG. 5 is a sectional view along V—V' of FIG. 4
Figure 6:
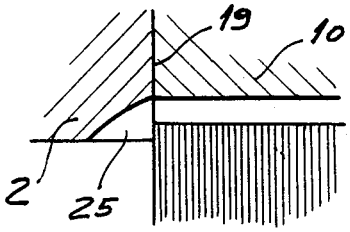
FIG. 6 is a sectional fragmentary view of the motor and casing along one of the channels of FIG. 3.

As shown in FIGS. 2 and 3, grooves such as 20, 21, 22, 23, 21', 22', 23' are made in the housing 10 around the stack 7 and are connected together in two series, at their end, by grooves such as 24 shown in FIGS. 4 and 5 so as to create in the housing, around the stack, a path such as shown, in perspective view, on FIG. 3. The last groove such as 23 is in communication with the interior of the motor cavity by a recess 25 made in the shoulder face 19.

As shown in FIGS. 1 and 2, the housing has a passage 26 connecting together both parts 10a and 10b of the motor cavity. A tube 27 is connected to the groove 20, a tube 27' to groove 21', and a tube 28 to passage 26.

When the compressor is working, tubes 27 and 27' are fed with liquid refrigerant which can come from any source of liquid at a pressure higher than the pressure inside the motor cavity, for instance the condenser or the liquid leaving the envelope 14 through tube 16.

The liquid cools the stack and its amount is so limited as to be completely or nearly completely vaporised before it leaves the path of grooves and enters the motor cavity through recess 25.

Figure 7:
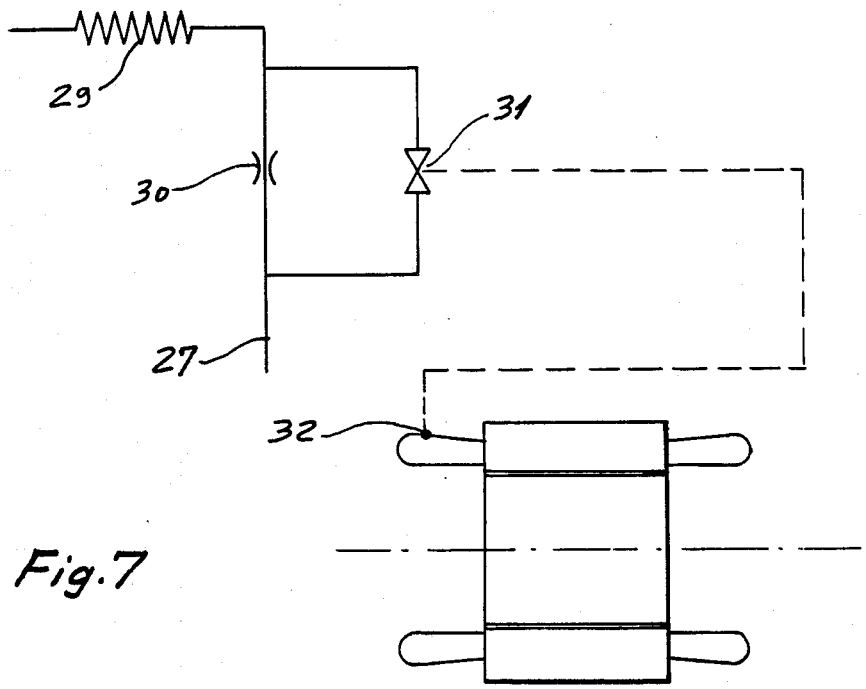
FIG. 7 is a schematic of a portion of the refrigeration circuit showing control of liquid injection into the motor.

For instance as shown in FIG. 7, liquid coming from condenser 29 is fed to tubes 27 and 27' through an orifice 30, which limits the amount of liquid; but a solenoid valve 31, mounted in parallel with orifice 30, can open if a thermal probe 32, set in one of the motor windings, detects a predetermined temperature threshold. Opening of valve 31 increases the amount of liquid entering tubes 27 and 27'.

As a practical example, with a compressor having about 2.8 $m^3$/minute intake capacity compressing refrigerant R22 from 7° C. to 55° C., the amount of gas coming from the centrifugal economiser is approximately 12 kg/minute in weight and it enters the motor cavity at around 27° C., leaves the motor cavity at around 47° C., with the mean temperature of the motor coils being about 61° C. Under these conditions, the said amount of gas removes approximately 3.4 kilowatt of heat out of the 4 kilowatt heat, i.e. 0.6 kilowatt, is rejected through vaporisation of the liquid in the path of grooves 21, 22, 23, . . . This needs only 0.2 kilogram liquid per minute.

If the motor was cooled by liquid only, a little more than 1 kilogram of liquid per minute would have been sufficient, i.e. around 10 times less in weight; however, once vaporised, the heat capacity of the gas being small by comparison with the vaporisation heat of the liquid, a little lack of liquid would have to be compensated by a great increase in gas temperature. This could bring the temperature of the gas at unacceptable values (fluorocarbon gas such as R22 starts to chemically break around 130° C.); and conversely a little excess of liquid would lead to the liquid not being completely vaporised. Thus, cooling the motor with liquid only, without any risk of excess liquid, is a very difficult problem which is eliminated by combining cooling by economiser gas together with liquid. On the other hand, cooling with economiser gas only results in too high temperatures of the gas in some cases where the amount of economiser gas is limited, especially when the compressor operates at a low compression ratio.

Even in cases such as the example given hereinabove, where liquid is not absolutely needed, some liquid injection in the motor housing, out of contact with the windings helps reducing the temperature, and this is good for the life of the motor.

Figure 8:
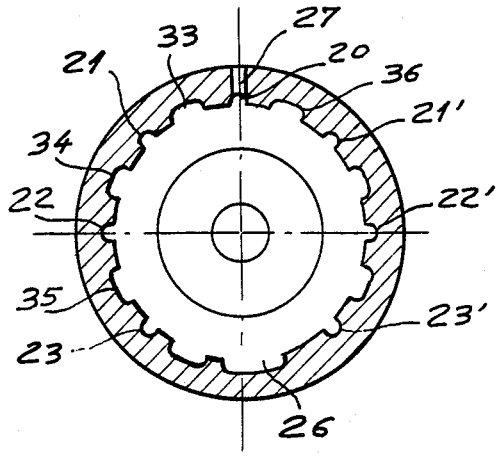
FIG. 8 shows a second embodiment along II—II' of FIG. 1.
Figure 9:
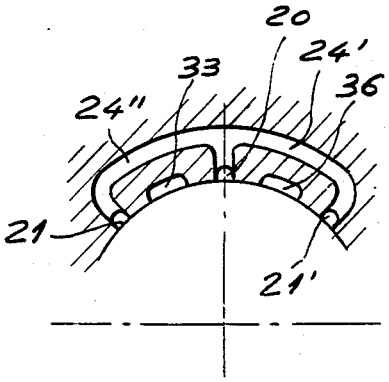
FIG. 9 is the view similar to FIG. 4 but showing the channels of FIG. 8.

As shown in FIGS. 8 and 9, it is also possible to imbricate with the liquid cooling a gas cooling of the side of the stack which is radially remote from the rotor. To this end, there is provided not only one groove such as 26, but a plurality of such grooves as 33, 34, 35, 36, etc . . . all around the motor with, between them, said grooves 20, 21, 22, 23, 21', 22', 23' connected together adjacent to the shoulder faces 18 and 19 by grooves such as 24' and 24'' passing radially outside of the gas channels such as 33 or 36.

Figure 10:
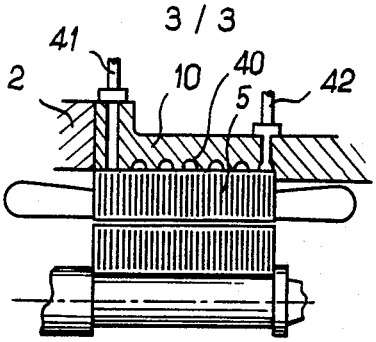
FIG. 10 is a fragmentary cross-sectional view of the electrical motor of another embodiment of the invention.
Figure 11:
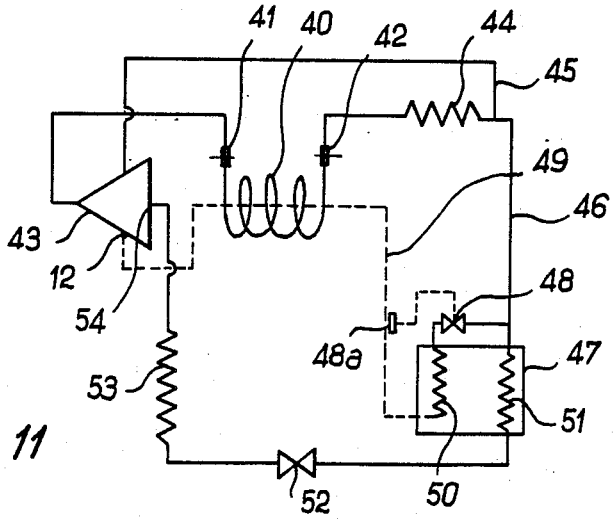
FIG. 11 and FIG. 12 are schematics showing two implementations of the motor of FIG. 10 in a refrigeration system.
Figure 12:
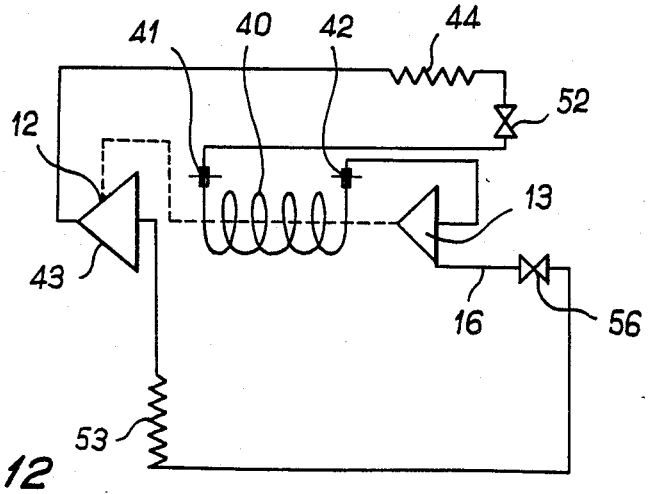

Two other embodiments of the invention are shown in FIGS. 10, 11 and 12.

FIG. 10 shows a simpler way—well known per se in centrifugal compressors—to provide conduit means adjacent to that side of the stator which is radially remote from the rotor. It shows a partial cut of the stator 5 surrounded by a housing 10 in which it is shrunk fit, the casing carrying a helical groove 40 connected to the outside by tubes 41 and 42.

In one refrigeration system arrangement shown in FIG. 11, the discharge port of a compressor schematically suggested in 43 is connected to tube 41, and tube 42 is connected to the condenser 44. From the condenser, liquid refrigerant flows by line 46 into an economiser system made of a subcooler 47 well known per se, with an expansion valve 48 controlled by the superheat measured by a known device 48a on a tube 49. Valve 48 controls flow of liquid from the condenser into a thermal exchange path 50 which is in thermal exchange relationship with a thermal exchange path 51 through which liquid coming from the condenser 44 then goes to the expansion valve 52 of the refrigerating circuit and to the evaporator 53 of the same, before returning to intake port 54 of the compressor.

As controlled by device 48a valve 48 sufficiently throttles the flow to line 49 in order that only gas reaches line 49. The heat absorbed by path 50 subcools the flow through path 51. The flash gas vaporised in the heat exchanger path 50 flows through line 49 into the motor cavity, where it cools the rotor and part of the stator, particularly the end turns of the motor coils, and is then injected into the compressor through the economiser hole 12.

Past the condenser 44, part of the liquid refrigerant is returned by pipe 45 and reinjected into the compressor to cool it; in single screw compressors such as shown in FIG. 1, it is not needed to inject oil. Liquid refrigerant can be injected in excess so that gas at discharge contains some liquid. Thus, the gas at discharge is wet, has no superheat.

So when the discharge gas containing liquid is sent into the conduit means 40, it brings a lot of cooling power to the stator.

In the above description all the discharge products coming from the compressor are shown as passing through the conduit means 40 but obviously, the invention would not be changed if only part of said discharge products were sent into the conduit means 40, particularly a part containing most of the liquid.

FIG. 12 shows a different arrangement which would apply to liquid injected compressors as shown in FIG. 1, but also to oil flooded compressors which are more conventional. The gas compressed by the compressor is sent to condenser 44 and then, past an expansion valve 52, into the conduit means 40, and then into an economiser separator which can be of the conventional gravity type or, as shown, of the centrifugal type 13 shown in FIG. 1 and disclosed bu U.S. Pat. No. 4,509,341. The liquid leaving by tube 16 reaches a valve 56 and then evaporator 53. As disclosed in U.S. Pat. No. 4,509,341, valve 56 regulates the radial depth of the annulus of liquid in the envelope of the centrifugal separator 13. The economiser gas, leaving the envelope of the economiser separator through annular space 17 (FIG. 1), cools the rotor of the motor, part of the stator thereof, and end turns of the motor coils before reaching the economise hole 12.

It should be noted that the embodiments shown in FIGS. 11 and 12 have the great advantage over embodiments such as that of FIG. 7, to eliminate the need of controlling the amount of liquid passing in the conduit means surrounding the stator.

In all cases, liquid is used to cool the stator but only at a distance from the motor coils. Adjacent to the coils, economiser gas is the sole cooling agent.

The conduit means provided by grooves in the casing could also be provided by equivalent means such as a tube welded in spiral around the stator. It is also clear that the invention, whereas shown to use cylindrical electric motors, could also use other electrical motors, such as a flat motor with a flat stator such as a printed circuit stator. In such a case, the side of the stator cooled by economiser gas would be the one provided with the printed circuits and adjacent to the rotor, the opposite side of the stator being cooled by the liquid. It is clear that while the description deals with refrigerant R-22, it could also apply to any refrigerant, especially those creating problems when contacting the coils in liquid form, such as refrigerants having a high conductivity or liable to break the varnish by impingement.

It should be now pointed out that this invention can be applied with any machine accepting an economiser port such as twin screws compressors, vane compressors, etc . . .

The centrifugal economiser can be replaced by a conventional economiser mounted outside of the compressor, for instance a subcooler of the type shown in FIG. 11, or a separation tank.

This invention has the advantage of allowing the use of hermetic motors without special protection against liquid, while cooling them at economiser pressure so as to save a lot of energy.

Moreover, the invention allows the compressor to suck wet gas, since intake gas is no longer passing through the motor to cool it but goes directly from the evaporator to the compressor.

This advantage is highly significant because it eliminates the need to superheat the gas in the evaporator, and this results in very substantial savings; a shell and tube evaporator ensuring 10° C. superheat is nearly twice as large as an evaporator producing the same cooling capacity but with 0° superheat; an evaporator costing roughly between 50 to 100% of the compressor itself, it is a major saving to be able to operate a compressor with a wet suction.

Another advantage is that, for liquid injected compressors without oil injection, if some oil is mixed with the refrigerant, it can be recovered on the bottom of the compressor by tube 28 and sent under pressure—because of the economiser pressure prevailing in the motor cavity—to the bearings of the compressor.

What is claimed is:

1. A method of cooling an electric motor of a hermetic motor compressor unit for compressing a main flow of refrigerant fluid in an at least partly gaseous state for supplying a refrigerating circuit in which said fluid is liquefied at least in part in a condenser and is vaporized at least in part in an evaporator, said method comprising the steps of:

in said refrigerating circuit, separating a substantially gaseous pressurized first flow of refrigerant fluid from said main flow supplying said first flow in a motor cavity provided inside a motor housing adjacent to a first side of a stator of said motor, said first side facing a rotor of said motor supplying said first flow from said motor cavity into the compressor through an economizer hole thereof subjected, in operation, at least at full load, to a pressure intermediate between an intake pressure and a discharge pressure of said compressor; and supplying with a second, at least partly liquid, flow of refrigerant fluid a path in which said second flow is in heat exchange relationship with said stator, remote from said first side.

2. A method as claimed in claim 1, comprising the steps of vaporizing at least a major quantity of liquid of the second flow in said path, and supplying to said economiser hole both the first flow and the second flow.

3. A method as claimed in claim 2, comprising the step of mixing the first flow and the second flow in the motor cavity.

4. A method as claimed in claim 1, comprising the steps of deriving said second flow from said main flow and detecting a temperature adjacent to the motor and controlling the second flow as a function of said temperature.

5. A method as claimed in claim 1 comprising the step of using said main flow as said second flow.

6. A method as claimed in claim 1, comprising the step of using as said second flow said main flow downstream of said condenser, and upstream of a gas separator performing said step of separating, in said refrigerating circuit, a substantially gaseous portion of said refrigerant fluid.

7. A method as claimed in claim 1, comprising the step of using as said second flow at least part of said main flow downstream of the compressor and upstream of a condenser of said refrigerating circuit, and injecting into said compressor liquid refrigerant in such an amount that the refrigerant fluid is wet at the compressor discharge port.

8. A method as claimed in claim 1, wherein the first flow is separated from the main flow downstream of said compressor and upstream of said evaporator.

9. A method as claimed in claim 1, wherein the first flow is separated from the main flow in a centrifugal economiser separator also urging liquid into said path.

10. A hermetic motor compressor unit comprising a rotary compressor adapted to compress a main flow of refrigerant fluid, an electric motor drivingly coupled to said rotary compressor for rotation therewith, said electric motor comprising a rotor mounted onto a shaft connecting the motor to the compressor, a stator mounted adjacent to the rotor in a motor housing connected to a casing of the compressor, separation means for separating in said refrigerant fluid a substantially gaseous portion thereof, means for supplying with said substantially gaseous portion a motor cavity provided in said housing adjacent a first side of said stator, said first side facing said rotor, conduit means connecting said motor cavity with a hole provided in the compressor casing in such a position as to be subjected, in use at full load, to a pressure intermediate between an intake pressure and a discharge pressure of the compressor, and channel means for guiding refrigerant fluid in heat exchange relationship with a second side of said stator, said second side being remote from said first side.

11. A hermetic motor-compressor unit as claimed in claim 10, wherein the separation means are centrifugal means.

12. A hermetic motor-compressor unit as claimed in claim 11, wherein the centrifugal means have, remote from an axis thereof, an outlet which is connected to an inlet of the channel means.

13. A hermetic motor-compressor unit as claimed in claim 11, wherein the centrifugal means are mounted on a shaft of the motor, with the motor being axially between the compressor and the centrifugal means.

14. A hermetic motor-compressor unit as claimed in claim 10, wherein the separating means is a subcooler.

15. A hermetic motor-compressor unit as claimed in claim 10, wherein a downstream end of the channel means communicates with the motor cavity.

16. A hermetic motor-compressor unit as claimed in claim 15, comprising gas circulation means for guiding gas refrigerant adjacent to said second side of said stator, said gas circulation means communicating with said motor cavity.

17. A refrigerating machine comprising a hermetic motor-compressor unit comprising a rotary compressor, a refrigerating circuit mounted operatively between a discharge port and an intake port of said compressor, an electric motor drivingly coupled to said rotary compressor for rotation therewith, said electric motor comprising a motor-rotor drivingly coupled to a compressor-rotor, a stator mounted adjacent to the motor-rotor in a motor housing connected to a casing of the compressor, separation means for separating in said refrigerating circuit a substantially gaseous portion of a refrigerant fluid present in use in said circuit, means for supplying with said substantially gaseous portion a motor cavity provided in said housing adjacent a first side of said stator, said first side facing said motor-rotor, conduit means connecting said motor cavity with a hole provided in the compressor casing in such a position as to be subjected, in use at full load, to a pressure intermediate between an intake pressure and a discharge pressure of the compressor, and channel means for guiding refrigerant fluid in heat exchange relationship with said stator adjacent a second side thereof which is remote from said first side.

18. A refrigerating machine as claimed in claim 17, wherein the separation means are centrifugal means mounted in series in said refrigerating circuit.

19. A refrigerating machine as claimed in claim 18, wherein the centrifugal means have, remote from an axis thereof, an outlet which is connected to an inlet of the channel means.

20. A refrigerating machine as claimed in claim 17, wherein the channel means are mounted in series in the refrigerating circuit.

21. A refrigerating machine as claimed in claim 20, wherein the channel means are mounted between said discharge port of the compressor and a condenser of said refrigerating circuit, and means are provided for injecting liquid in said compressor.

22. A refrigerating machine as claimed in claim 20, wherein the channel means are mounted downstream of a condenser of said refrigerating circuit and upstream of said separating means.

23. A refrigerating machine as claimed in claim 17, wherein the separating means is a subcooler having a vapour path connected to the motor cavity and a subcooled liquid path arranged in the refrigerating circuit downstream of a condenser and upstream of an expansion valve of the refrigerating circuit.

* * * * *